United States Patent [19]

Bartmann et al.

[11] Patent Number: 4,852,464

[45] Date of Patent: Aug. 1, 1989

[54] TWO-STAGE TELESCOPING HYDRAULIC CYLINDER

[75] Inventors: Günter Bartmann, Holzwickede; Gerd Bräckelmann, Unna-Uelzen, both of Fed. Rep. of Germany

[73] Assignee: Montan-Hydraulik GmbH, Holzwickede, Fed. Rep. of Germany

[21] Appl. No.: 155,722

[22] PCT Filed: Jul. 2, 1987

[86] PCT No.: PCT/DE87/00297

§ 371 Date: Jan. 28, 1988

§ 102(e) Date: Jan. 28, 1988

[87] PCT Pub. No.: WO88/00296

PCT Pub. Date: Jan. 14, 1988

[30] Foreign Application Priority Data

Jul. 3, 1986 [DE] Fed. Rep. of Germany ..... 36224243

[51] Int. Cl.[4] ..... F01B 7/20

[52] U.S. Cl. ..... 92/53; 91/159; 91/167 R; 91/173

[58] Field of Search ..... 92/51, 52, 53; 91/165, 91/159, 167 A, 170 R, 167 R, 173, 530

[56] References Cited

U.S. PATENT DOCUMENTS

| | | | |
|---|---|---|---|
| 2,565,730 | 8/1951 | Johnson et al. | 92/53 |
| 2,910,049 | 10/1959 | Calder | 92/53 |
| 2,933,070 | 4/1960 | Trumper et al. | 92/52 |
| 3,136,221 | 6/1964 | Walker | 92/53 |
| 3,252,680 | 5/1966 | Lee et al. | 92/52 |
| 3,603,207 | 9/1971 | Parrett | 91/173 |
| 3,610,100 | 10/1971 | Hoffman | 91/167 |
| 3,696,712 | 10/1972 | Sung | 92/52 |
| 3,902,718 | 9/1975 | Avon | 92/52 |
| 3,956,970 | 5/1976 | Kupiek et al. | 91/173 |
| 3,957,125 | 5/1976 | Russell | 92/53 |
| 3,958,376 | 5/1976 | Campbell | 92/53 |
| 3,970,171 | 7/1976 | Honecker et al. | 92/53 |

FOREIGN PATENT DOCUMENTS

| | | | |
|---|---|---|---|
| 1278081 | 9/1968 | Fed. Rep. of Germany | 92/52 |
| 413185 | 3/1946 | Italy | 91/168 |

*Primary Examiner*—Robert E. Garrett
*Assistant Examiner*—Thomas Denion
*Attorney, Agent, or Firm*—Max Fogiel

[57] ABSTRACT

To allow a telescoping cylinder that is ordinarily operated in a fixed sequence to also be operated in a simultaneous mode, the first stage (12) of the cylinder is provided with an end plate (126), the cylindrical gap (114) in the first stage communicates directly with the space (133) inside the second stage (13) that is sealed off by the end plate, and a third cylindrical gap (124 & 124'), which is created in the second stage out of the sections (124 & 124') that are sealed off (1331) and derive from the end plate in the first stage, is provided with a pressure-medium line (23) that communicates through a telescoping passage (1131 & 1232) between the floor (111) of the cylinder (110 and the end plate (126) in the first stage, specifically satisfying the demand that the cylindrical gap (114) in the first stage (12) and the space (133) inside the first stage are equal in volume.

5 Claims, 6 Drawing Sheets

Figure 1:
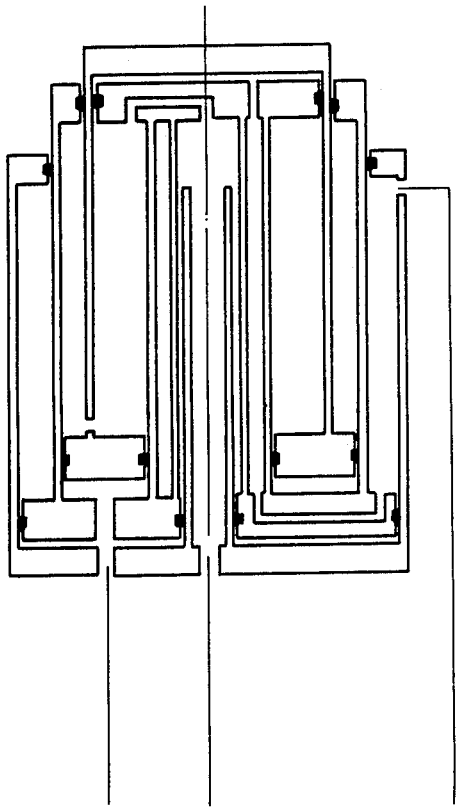

| | | Line | | | |
|---|---|---|---|---|---|
| | | 21 | 23 | 22 | |
| Operating positions | a | P | T | X | Extension in simultaneous mode |
| | b | T | P | X | Retraction in simultaneous mode |
| | c | P | X | T | Extending first stage |
| | d | T | X | P | Retracting first stage |
| | e | T | T | P | Extending second stage |
| | f | T | P | T | Retracting second stage |

X - blocked

T - reservoir

P - pump

FIG. 6

TWO-STAGE TELESCOPING HYDRAULIC CYLINDER

The invention concerns a two-stage telescoping hydraulic cylinder with two pistons, one of which slides back and forth inside the other, with cylindrical gaps between the individual telescoping sections, with a pressure-medium line communicating with the cylinder's pressure space, with another pressure-medium line communicating with the cylindrical gap in the first stage and above its floor, and with constant communication between the cylindrical pressure space and the pressure space in the first stage and constant communication between the first stage and the space inside the second stage. A three-stage telescoping cylinder is known from German AS No. 1 107 383.

Two-stage telescoping hydraulic cylinders are mainly operated today in a fixed sequence, with the first stage being extended first, followed by the second stage, and the second stage being retracted first, followed by the first stage. When, however the control valves are appropriately designed, it is also possible to operate the devices in a different sequence, although it is still impossible to extend or retract the stages in known two-stage telescoping hydraulic cylinders simultaneously. It would, however, be desirable in various situations to be able to operate both stages simultaneously. The two stages can of course be operated simultaneously by means of an area-independent displacement system, although the area of the base of the cylindrical gap in the first stage must then of course be exactly as large as the area of the piston in the second stage. A system of this type, however, is so large that it cannot be employed, at least in the applications conventional for this kind of telescoping cylinder, specifically traveling cranes.

With the aforesaid state of the art as a point of departure, the object of the present invention is to allow the two stages of a two-stage telescoping hydraulic cylinder to be operated simultaneously while keeping its dimensions small enough to allow it to be employed in traveling cranes etc.

This object is attained in accordance with the invention in a two-stage telescoping hydraulic cylinder with two pistons, one of which slides back and forth inside the other, with cylindrical gaps between the individual telescoping sections, with a pressure-medium line communicating with the cylinder's pressure space, with another pressure-medium line communicating with the cylindrical gap in the first stage and above its floor, and with constant communication between the cylindrical pressure space and the pressure space in the first stage and constant communication between the first stage and the space inside the second stage in that the space inside the second stage is demarcated by an end plate on the first stage that, in conjunction with the second piston, creates in the second stage a cylindrical gap consisting of communicating sections, in that the cylindrical gap communicates with another pressure-medium line through a telescoping passage that extends through the floor of the first stage and the floor of the second stage to the end plate in the first stage, and in that the cylindrical gap in the first stage and the space inside the second stage are equal in volume.

Since the cylindrical gap in the first stage and the space inside the second stage are equal in volume, this design encompasses telescoping cylinders with stages of differing lengths.

The telescoping cylinder in accordance with the invention can be operated in any way desired, with (a) both stages extending simultaneously, (b) both stages retracting simultaneously, (c) the first stage extending while the second stage remains retracted, (d) the first stage retracting while the second stage remains retracted, (e) the second stage extending while the first stage remains retracted, and (f) the second stage retracting while the first stage remains retracted, whereby operations (c) and (f) can be carried out while the stationary stage remains partly extended or retracted and a transition from operations (a) and (b) to operations (c) and (f) and vice versa can always be undertaken.

The aforesaid operations (a) through (f) will be described in detail with reference to the drawing.

The new telescoping cylinder accordingly combines the advantages of a simultaneous-operation cylinder with those of the telescoping cylinders that are operated in a fixed sequence, as well as being desirably compact. The cylinder is in particular operated simultaneously when rapid telescoping is desired. The operation wherein only the first stage of the cylinder is extended and retracted is especially practical when the boom is sloping steeply and heavy loads have to be handled. The operation wherein only the second stage is extended and retracted is practical when the boom is very low and heavy loads have to be handled. Another application for the latter mode of operation is in adding on another stage. The capacity to operate both stages of the telescoping cylinder simultaneously with both accomplishing a stroke of the same distance is especially desirable from the aspect of statics in relation to traveling cranes and similar equipment with long booms.

The pressure space in the second stage and the cylindrical gap in the second stage in one embodiment of the invention are at least essentially equal in area.

The cylindrical gap in the first stage and the space inside the second stage in one preferred embodiment of the invention are equal in area.

From the aspect of design it is practical for the telescoping passage that leads to the cylindrical gap in the second stage to communicate with the gap through a connecting line in the end plate of the first stage.

The section of the telescoping passage into the cylindrical gap in the second stage in one embodiment of the invention consists of a double pipe that extends from the floor of the first stage to the end plate in the first stage with its outer flow zone connecting the cylindrical gap in the first stage with the space inside the second stage through a line in the floor of the first stage.

Figure 2:
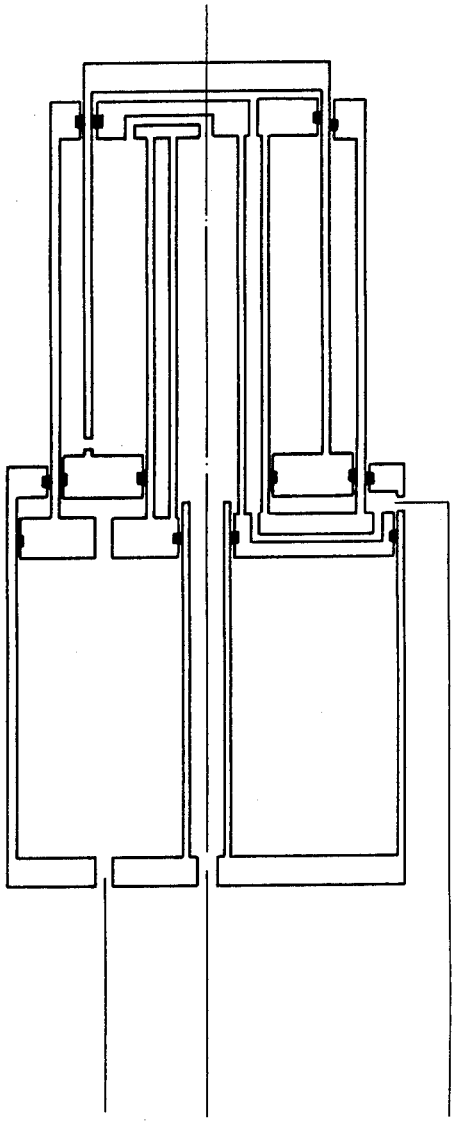
Figure 3:
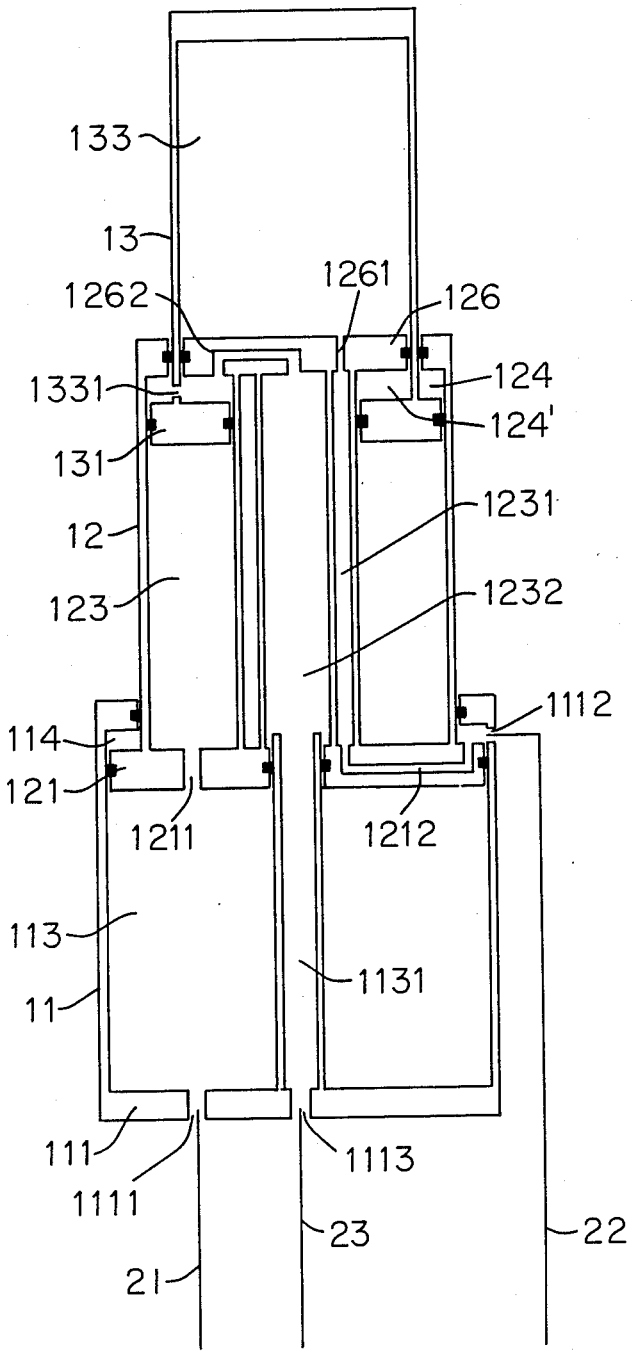
Figure 4:
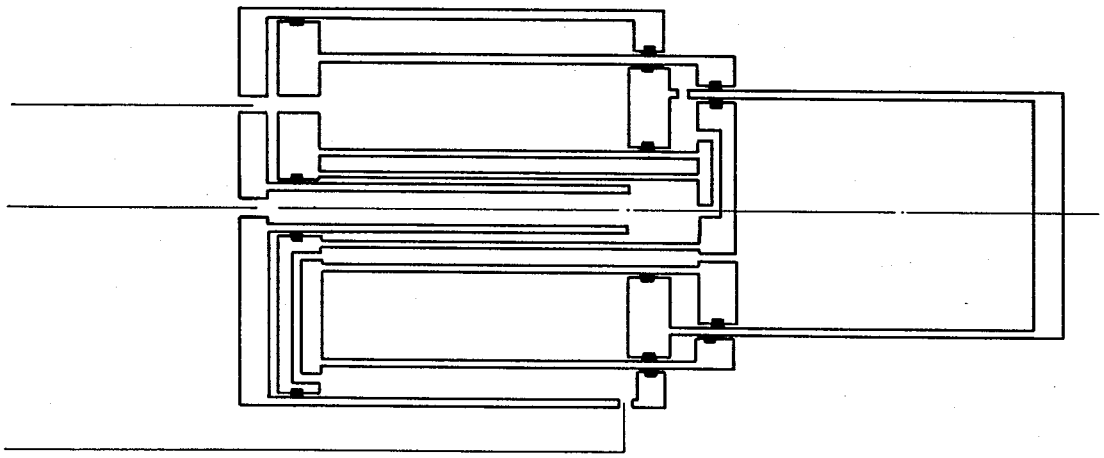
Figure 5:
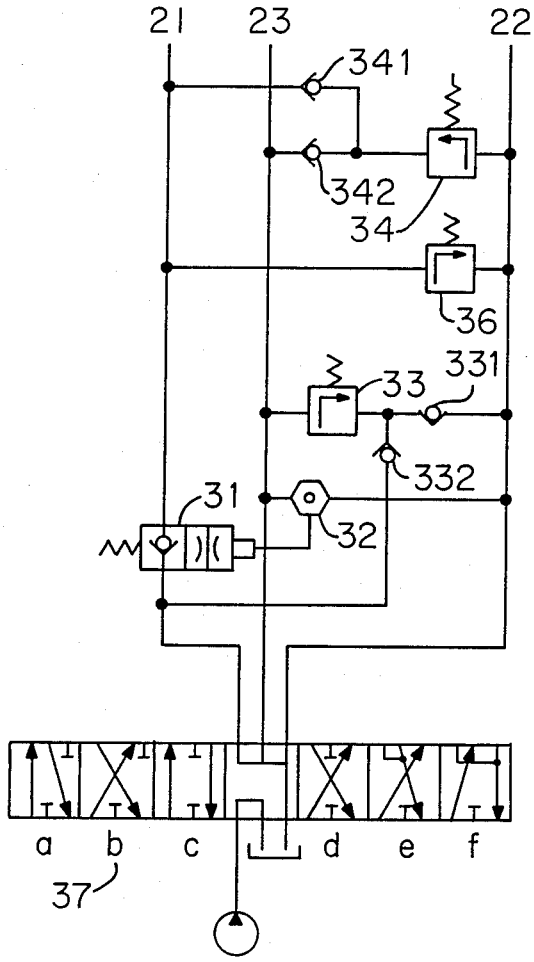

The invention will now be described in detail with reference to the drawing, wherein FIG. 1 is an illustration of the new telescoping cylinder in the retracted state, FIG. 2 illustrates the cylinder in FIG. 1 with the first stage extended, FIG. 3 illustrates the cylinder in FIG. 1 completely extended, FIG. 4 illustrates the cylinder in FIG. 1 with the second stage extended, FIG. 5 illustrates controls for the cylinder illustrated in FIGS. 1 through 4, and FIG. 6 is a table showing the various combinations of operations attainable with the circuitry illustrated in FIG. 5.

The two-stage telescoping cylinder illustrated in FIG. 1 consists of a basic cylinder 11 with a pressure space 113, with a hollow piston 12 (the first stage) that leads into it leaving a cylindrical gap 114 (the first-stage gap) with a pressure space 123 and another hollow piston 13 (the second stage) leading into it leaving another cylindrical gap (the second-stage gap) with a space 133 inside it. The piston 12 in the first stage has an end plate 126 that demarcates the space 133 inside the second stage. The end plate 126 of the first stage creates in conjunction with the piston 13 of the second stage the second-stage cylindrical gap 124 and 124' that consists of the communicating (1331) sections 123 and 124'.

The cylindrical pressure space 113 (first-stage pressure space) and the pressure space 123 in the second stage communicate through an opening 1211 in the floor 121 of the first stage. The cylindrical gap 114 in the first stage communicates with the space 133 inside the second stage through a line 1212 in the floor 121 of the first stage that merges into a passage 1231 extending between floor 121 and end plate 126 through the floor 131 of the second stage and opening into another passage 1261 in end plate 126.

A pressure-medium line 21 opens (1111) into cylinder pressure space 113 at the floor 111 of cylinder 11. Another pressure-medium line 22 communicates (1112) above the floor 121 of the first stage with the first-stage cylindrical gap 114. Still another pressure-medium line 23 opens (1113) into a telescoping passage 1131 and 1232 that extends through the floor 121 of the first stage and the floor 131 of the second stage to the end plate 126 of the first stage. Pressure medium line 23 communicates with the cylindrical gap 124 and 124' in the second stage through passage 1131 and 1232 and through a line 1262 in the end plate 126 of the first stage. One section 1232 of the telescoping passage 1131 and 1232 that connects pressure-medium line 23 to the cylindrical gap 124 and 124' in the second stage is combined with the passage 1231 that connects the cylindrical gap 114 in the first stage with the space 133 inside the second stage in the illustrated embodiment into a double pipe 1231 and 1232.

When the stages of the telescoping cylinder are operated simultaneously, pressure-medium line 22 is removed. The device is extended in this case by supplying pressure medium to the pressure space 113 in cylinder 11 through pressure medium line 21, extending the second stage, piston 12 in other words. Piston 12 as it travels forces pressure medium out of the cylindrical gap 114 in the first stage into the space 133 inside the second stage. Assuming that the cylindrical gap 114 in the first stage and the space 133 inside the second stage are equal in volume, the pressure medium forced out of the cylindrical gap in the first stage and into the space 133 inside the second stage will simultaneously extend the second stage, so that both stages will be in operation simultaneously. The stages of the cylinder will operate at the same speed when the cylindrical gap 114 in the first stage and the space 133 inside the second stage are equal in area. The pressure medium forced out of the cylindrical gap 124 and 124' in the second stage during the extension will flow back to the reservoir through pressure medium line 23. To retract the telescoping cylinder, pressure medium is supplied to the cylindrical gap 124 and 124' in the second stage through pressure-medium line 23. Subject to the pressure medium supplied to the cylindrical gap 124 and 124' in the second stage, the second stage of the telescoping cylinder in retracted. The pressure medium simultaneously forced out of the space 133 inside the second stage and into the cylindrical gap 114 in the first stage will accordingly retract the first stage. The pressure medium simultaneously forced out of the pressure space 123 in the second stage and out of the pressure space 113 in the first stage will flow back to the reservoir through pressure-medium line 21.

If it is necessary to extend the first stage of the telescoping cylinder with the final stage (the second stage) remaining retracted, pressure-medium line 23 is removed. Extension is then accomplished by supplying pressure medium again to the pressure space 113 of cylinder 11 through pressure-medium line 21 to extend the first stage of the telescoping cylinder, whereas the second or final stage remains stationary. The pressure medium simultaneously forced out of cylindrical gap 14 will flow back to the reservoir through pressure-medium line 22. The pressure medium that does remain upstream of the second stage while medium is being supplied to the pressure space 113 in the first stage will have no effect on the second stage because the pressure medium in the cylindrical gap 124 and 124' in the second stage is enclosed. To retract the telescoping cylinder, pressure medium is supplied to the cylindrical gap 114 in the first stage through pressure-medium line 22, retracting the first stage again, whereby the medium in the pressure space in the first stage will flow back to the reservoir. In this case as well the pressure medium supplied to cylindrical gap 144 will have no effect on the second stage because the pressure medium in the cylindrical gap 124 and 124' in the second stage is enclosed.

If it is necessary to extend the second stage of the telescoping cylinder while the first stage remains in its initial position, pressure-medium lines 21 and 23 are opened and pressure medium is supplied to the cylindrical gap 114 in the first stage through pressure-medium line 22. This medium arrives over the path 1212, 1231, and 1261 in the space 133 inside the second stage. Space 133 now assumes the function of the pressure space in the second stage, which extends. The pressure medium forced out of cylindrical gap 124 and 124' will flow back to the reservoir over the path 1262, 122, and 1131 and through pressure-medium line 23. Simultaneously, as the second stage extends, that is, the pressure space 123 in the first stage will fill with pressure medium suction through pressure-medium line 21. To retract, pressure medium is supplied to the cylindrical gaps 124 and 124' in the second stage through pressure-medium line 23 and the subsequent path 1131, 1232, and 1262 with pressure-medium lines 21 and 22 open. The pressure medium supplied to cylindrical gaps 124 and 124' retracts the second stage. The pressure medium simultaneously forced out of the space 133 inside the second stage flows back to the cylindrical gap 114 in the first stage over the path 1231 and 12112 and on to the reservoir through pressure-medium line 22. The pressure medium in the pressure space 123 in the second stage simultaneously flows back to the reservoir through pressure-medium line 21.

To operate the telescopng cylinder, each pressure-medium line 21, 22, and 23 is in the simplest case provided with a 3-3 way valve, whereby each valve is adjusted as will be evident from FIG. 6.

FIG. 5 illustrates a logical circuit that allows the telescoping cylinder to be operated as described. There is a controllable countertorque valve with an integrated check valve in pressure-medium line 21. This valve ensures on the one hand that the pressure medium in pressure spaces 113 and 123 cannot flow out unintendedly and on the other that pressure medium will flow out constricted during retraction. Countertorque valve 31 can be activated through control lines that extend not only from pressure-medium line 22 but also from pressure-medium line 23 and meet at a shuttle valve 32. Associated with pressure-medium line 23 is a pressure-relief 33 with downstream check valves 331 and 332 to divert the excess pressure in passage 1131 and 1231 to whichever pressure-medium line 21 or 22 is without pressure. A pressure-relief valve associated with pressure-medium line 22 ensures while the telescoping cylinder in in simultaneous operation that, if the final stage begins to arrive in its limiting position prematurely, the first stage can also be transferred into its limiting position. The excess pressure that simultaneously builds up in the cylindrical gap 114 in the first stage will be diverted through valve 34 in one of the pressure-medium lines 21 and 23, in relation to which the valve 34 is protected by check valves 341 and 342. A pretensioning valve 36 handles the opposite situation that is exceptional but nevertheless possible when the telescoping cylinder is operating in the simultaneous mode, wherein the first stage enters its limiting position prematurely and the second stage is accordingly not yet in its limiting position and is being driven only by pressure medium supplied at the floor. The pressure medium still needed to completely fill the space 133 inside the final stage is in this case additionally supplied through the in itself removed pressure-medium line 22, supplying pressure-medium line 22 from pressure-medium line 21 through pretensioning valve 36. Number 37 is what is called a control disk, which represents in the illustration the various wiring diagrams associated with the different modes of operation.

We claim:

1. A two-stage telescoping hydraulic cylinder with two telescoping pistons, one of said pistons sliding back and forth inside the other piston, said telescoping pistons having cylindrical gaps therebetween; said cylinder having a pressure space; a first pressure-medium line communicating with said pressure space; said cylinder having a first stage and a second stage; a second pressure-medium line communicating with a cylindrical gap in said first stage above the bottom of said first stage; said first stage having a pressure space therein; said second stage having a pressure space therein; means for constant communication between said pressure space of said cylinder and said pressure space in said first state; means for constant communication between said pressure space of said first stage and said space in said second stage; an end plate on said first stage and defining said space in said second stage; said first stage and said second piston forming said cylindrical gap of said second stage, said cylindrical gap having communicating sections; telescoping passage means extending through the bottom of said first stage and the bottom of said second stage to the end plate of the first stage, said cylindrical gap of said second stage communicating with a third pressure-medium line through the bottom of said cylinder and said telescoping passage means; said cylindrical gap of said first stage and said space in said second stage having equal volumes; said pressure space of said second stage and the cylindrical gap of said second stage having substantially equal surface areas.

2. A two-stage telescoping hydraulic cylinder as defined in claim 1, wherein the cylindrical gap in said first stage and the space inside said second stage having substantially equal areas.

3. A two-stage telescoping hydraulic cylinder as defined in claim 1, including a connecting line in said end plate of said first stage, said telescoping passage means communicating with said cylindrical gap in said second stage through said connecting line in said end plate.

4. A two-stage telescoping hydraulic cylinder as defined in claim 1, wherein said telescoping passage means has a section extending into said cylindrical gap in said second stage and comprising a double pipe extending from the bottom of the first stage to said end plate in said first stage; a flow line in the bottom of said first stage, said double pipe having an outer flow zone connecting the cylindrical gap in said first stage with the space in said second stage through said line in the bottom of said first stage.

5. A two-stage telescoping hydraulic cylinder with two telescoping pistons, one of said pistons sliding back and forth inside the other piston, said telescoping pistons having cylindrical gaps therebetween; said cylinder having a pressure space; a first pressure-medium line communicating with said pressure space; said cylinder having a first stage and a second stage; a second pressure-medium line communicating with a cylindrical gap in said first stage above the bottom of said first stage; said first stage having a pressure space therein; said second stage having a pressure space therein; means for constant communication between said pressure space of said cylinder and said pressure space in said first stage; means for constant communication between said pressure space of said first stage and said space in said second stage; an end plate on said first stage and defining said space in said second stage; said first stage and said second piston forming said cylindrical gap of said second stage, said cylindrical gap having communicating sections; telescoping passage means extending through the bottom of said first stage and the bottom of said second stage to the end plate of the first stage, said cylindrical gap of said second stage communicating with a third pressure-medium line through the bottom of said cylinder and said telescoping passage means; said cylindrical gap of said first stage and said space in said second stage having equal volumes; said pressure space of said second stage and the cylindrical gap of said second stage having substantially equal surface areas; said cylindrical gap in said first stage and the space in said second stage having substantially equal areas; a connecting line in said end plate of said first stage, said telescoping passage means extending to said cylindrical gap in said second stage communicating with the gap through said connecting line in said end plate; said telescoping passage means extending into said cylindrical gap in said second stage having a section comprising a double pipe extending from the bottom of said first stage to said end plate in said first stage, a flow line in the bottom of said first stage, said double pipe having a flow zone connecting the cylindrical gap in said first stage with the space in said second stage through said flow line in the bottom of said first stage.

* * * * *